US009446820B2

(12) United States Patent
Boerleider et al.

(10) Patent No.: US 9,446,820 B2
(45) Date of Patent: Sep. 20, 2016

(54) MOORING DEVICE FOR MOORING A SHIP

(71) Applicant: European Intelligence B.V., Dordrecht (NL)

(72) Inventors: Johan Marlon Boerleider, Dordrecht (NL); Gerardus Antonius Jozef Mampaeij, Dordrecht (NL); Constantinus Wilhelmus Leenders, The Hague (NL); Wouter van Reenen, Rotterdam (NL)

(73) Assignee: EUROPEAN INTELLIGENCE B.V., Dordrecht (NL)

( * ) Notice: Subject to any disclaimer, the term of this patent is extended or adjusted under 35 U.S.C. 154(b) by 0 days.

(21) Appl. No.: 14/531,430

(22) Filed: Nov. 3, 2014

(65) Prior Publication Data

US 2015/0047545 A1 Feb. 19, 2015

Related U.S. Application Data

(63) Continuation of application No. PCT/NL2013/050321, filed on Apr. 29, 2013.

(30) Foreign Application Priority Data

May 3, 2012 (NL) ..... 2008746

(51) Int. Cl.
*B63B 21/02* (2006.01)

(52) U.S. Cl.
CPC ..... *B63B 21/02* (2013.01)

(58) Field of Classification Search
CPC ..... B63B 21/02
USPC ..... 114/230.15, 230.5
See application file for complete search history.

(56) References Cited

U.S. PATENT DOCUMENTS

| | | | | |
|---|---|---|---|---|
| 2006/0087391 | A1* | 4/2006 | Ferro | B63B 21/02 335/284 |
| 2007/0084395 | A1* | 4/2007 | Hamilton | B63B 21/02 114/230.1 |
| 2012/0305728 | A1* | 12/2012 | Gravendeel | A63B 27/00 248/309.4 |
| 2015/0047545 | A1* | 2/2015 | Boerleider | B63B 21/02 114/230.15 |
| 2015/0197315 | A1* | 7/2015 | Boerleider | B63B 21/02 114/230.15 |

FOREIGN PATENT DOCUMENTS

| | | | |
|---|---|---|---|
| DE | 1129081 | 5/1962 | |
| DE | 1911949 | 10/1970 | |
| NL | 8600973 | 11/1987 | |
| NL | WO 2010053368 A1 * | 5/2010 | B63B 21/02 |
| WO | 2010/053368 | 5/2010 | |
| WO | 2013/165239 | 11/2013 | |

* cited by examiner

*Primary Examiner* — Lars A Olson
*Assistant Examiner* — Jovon Hayes
(74) *Attorney, Agent, or Firm* — Jeffrey D. Myers; Peacock Myers, P.C.

(57) ABSTRACT

Mooring device for mooring a ship and comprising a base, a movable arm construction supported by the base, and at least one magnet mounted in a frame, which frame is supported by the movable arm construction, wherein the frame is provided with at least one leaf spring, and at least one magnet is supported by the at least one leaf spring. Further there is a hinge connected to the movable arm construction, and the frame comprises two beams on opposite sides of the hinge, wherein each beam supports at least one leaf spring and a magnet mounted on said at least one leaf spring.

8 Claims, 1 Drawing Sheet

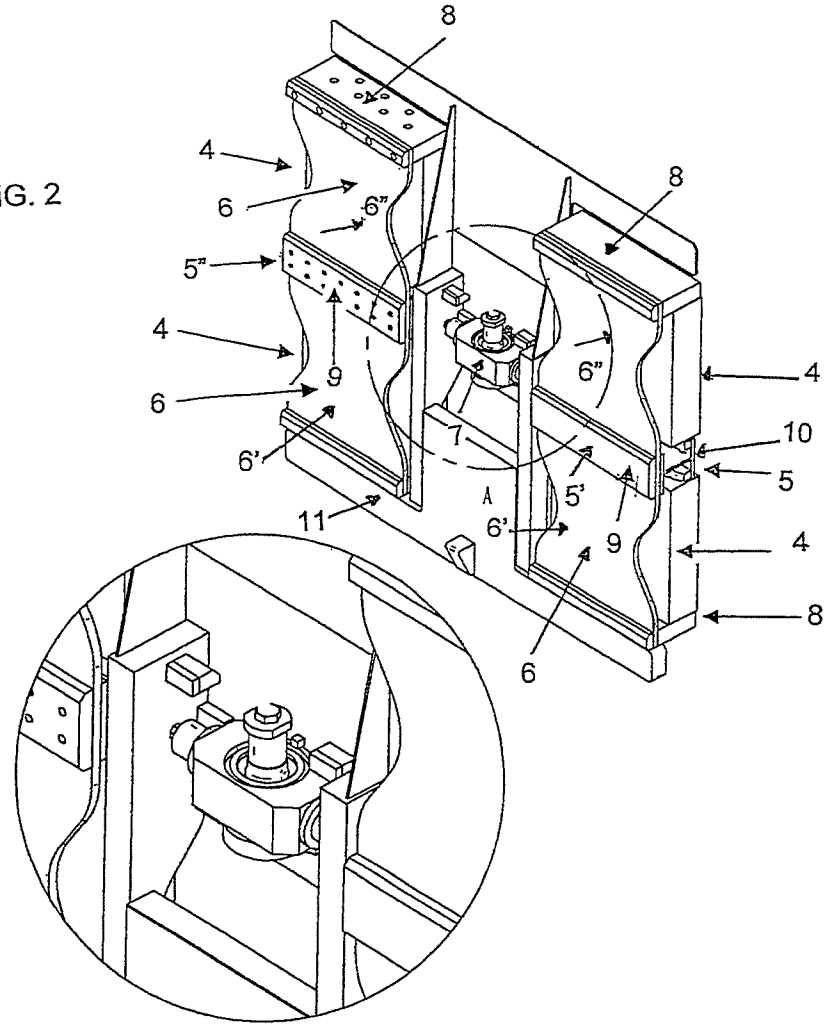
FIG. 2
FIG. 3
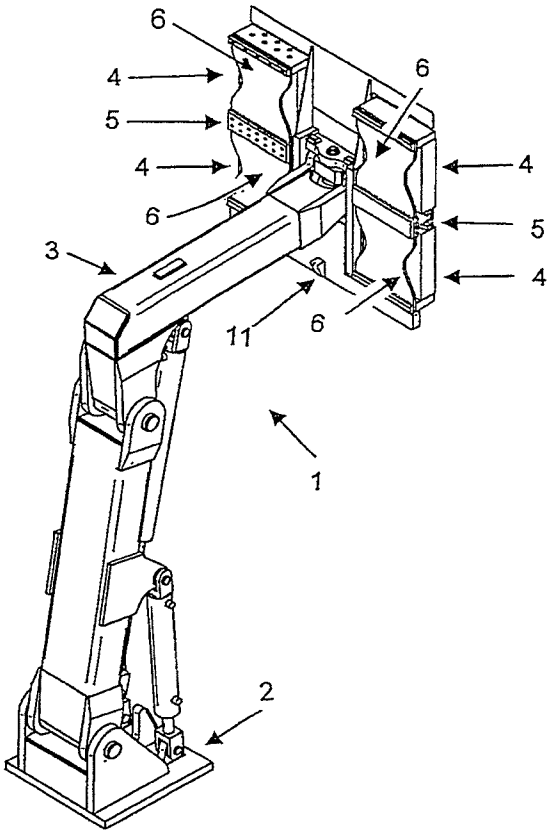
FIG. 1

MOORING DEVICE FOR MOORING A SHIP

CROSS-REFERENCE TO RELATED APPLICATIONS

This application is a continuation application of Patent Cooperation Treaty Application No. PCT/NL2013/050321, entitled "Mooring Device for Mooring a Ship", filed on Apr. 29, 2013, which claimed priority to Netherlands Patent Application No. 2008746, filed on May 3, 2012, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to a mooring device for mooring a ship and comprises a base, a movable arm construction supported by the base, and at least one magnet mounted in a frame, which frame is supported by the movable arm construction.

2. Description of Related Art

Such a mooring device is known from WO2010/053368. According to this citation the mooring device is placed ashore and is used for moving the magnet to the ship's hull and mounting the ship to the quayside. According to one of the aspects of the invention the mooring device can however also be mounted on the ship, wherein the magnet is connected to a magnetizable fixture onshore. The mooring device can also be used for connecting one ship to another ship. The magnet to be employed can be either permanent, semipermanent or it can be an electromagnet.

Although the mooring device known from WO2010/053368 is devised to be flexible with a view that the surface of the ship's hull need not be perfectly perpendicular to the mooring magnet surface to take care of the fact that most ship hulls are by nature of non-planar design, it is found that the degree of flexibility achieved with the known mooring device is insufficient in real life. It is therefore a first object of the invention to improve the known mooring device. Secondly it is an object of the invention to accommodate the mooring device to higher degrees of irregularity in the ship's hull than is possible with the prior art mooring device. The third objective of the invention is to provide a mooring device which is easier to handle and which has improved versatility in its use. These and other objectives will become apparent from the following disclosure of the invention.

BRIEF SUMMARY OF THE INVENTION

The mooring device of the invention and/or a ship provided with such a mooring device has the features of one or more of the appended claims.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 1 shows the mooring device of the invention in a perspective view;

FIG. 2 shows the frame with the magnets of the mooring device of the invention; and FIG. 3 shows in a detailed view the ball and socket joint with which the frame is mounted to the movable arm construction of the mooring device of the invention.

DETAILED DESCRIPTION OF THE INVENTION

According to a first aspect of the invention the frame is provided with at least one leaf spring, and the at least one magnet is supported by the at least one leaf spring. Such a leaf spring or leaf springs enable that the magnet or magnets supported thereby can easily accommodate to the curvature of the ship's hull.

According to the prior art it is known that the frame is with a hinge connected to the movable arm construction. According to the invention it is preferred that the frame comprises two beams on opposite sides of such a hinge, and that each beam supports at least one leaf spring and a magnet mounted on said at least one leaf spring. By providing the beams on opposite sides of the hinge a balanced construction is possible which supports the ease of handling of the mooring device.

To further support the ease of handling by providing a balanced construction, it is preferred that each beam is provided with two leaf springs, wherein each leaf spring supports a magnet, and said two leaf springs are provided on opposite sides of the beam.

A very noteworthy aspect of the invention is that for each leaf spring the magnet or magnets mounted thereon connect to the leaf spring at a position distant from the beam. Quite surprisingly this increases not only the flexibility in moves that the magnet can make with reference to the frame in three degrees of freedom of a coordinate system, but it also arranges that the preferential movement direction of the magnets is perpendicular to the frame and consequently also perpendicular to the ship's hull to which the magnets must be applied. It goes without saying that this is very beneficial for connecting the magnets to the ship's hull whilst avoiding that part of the magnets might acquire incomplete contact with the hull.

The mooring device of the invention is suitably ar-ranged such that each beam is embodied as an H-beam, wherein the leaf spring or leaf springs connect to one leg of the H-beam at a backside of the magnet or magnets so as to arrange that in a rest position a front side of the magnet or magnets can be substantially flush with an opposite leg of the H-beam. This provides a suitably balanced construction, which again supports the ease of handling of the mooring device.

It is also preferred that the frame is provided with a counterweight or counterweights so as to provide the magnet or magnets mounted to the frame with a preferential orientation in a vertical plane with reference to the hinge.

In still another aspect of the invention the hinge is embodied as a ball and socket joint. Making use of such a ball and socket joint is beneficial for the maneuverability of the frame with the magnets with reference to the movable arm construction to which the frame connects.

It is preferred that the ball and socket joint connects at a central point of the frame so as to arrange that the frame is mirror symmetric left and right of the movable arm construction supporting the frame.

The invention will hereinafter be further elucidated with reference to the drawing of a schematic representation of a single mooring device according to the invention.

Wherever in the figures the same reference numerals are applied, these numerals refer to the same parts.

With reference first to FIG. 1, the mooring device 1 of the invention is shown in a perspective view. This mooring device 1 for mooring a ship comprises a base 2, a movable arm construction 3 supported by the base 2, and at least one but in practice usually several magnets 4 mounted in a frame 5. The frame 5 is supported by the movable arm construction 3. FIG. 2 clearly shows that the frame 5 is connected to the movable arm construction 3 with an intermediate hinge 7.

According to the invention the frame 5 is provided with at least one but usually several leaf springs 6, wherein each magnet 4 is supported by one of the leaf springs 6. This is also shown in FIG. 2.

The detail of FIG. 3 shows that the intermediate hinge 7 is embodied as a ball and socket joint. FIG. 2 clearly shows that the frame 5 comprises two beams 5', 5" on opposite sides of the hinge 7, and that each beam 5', 5" supports two leaf springs 6', 6", wherein each leaf spring 6', 6" supports a magnet 4, and said two leaf springs 6', 6" are provided on opposite sides of the beam 5.

Again referring to FIG. 2 it is shown that for each leaf spring 6', 6" the magnet or magnets 4 mounted thereon connect to the leaf spring 6', 6" with a constructional element 8 at a position distant from the beam 5. FIG. 2 also shows that each beam 5 is embodied as an H-beam, wherein the leaf spring or leaf springs 6', 6" connect to one leg 9 of the H-beam at a backside of the magnet or magnets 4 so as to arrange that in a rest position of the mooring device 1 a front side of the magnet or magnets 4 can be substantially flush with an opposite leg 10 of the H-beam.

Both FIG. 1 and FIG. 2 show that the frame 5 is provided with a counterweight 11 or counterweights so as to provide the magnet or magnets 4 mounted to the frame 5 with a preferential orientation in a vertical plane with reference to the hinge 7. This ensures that the surface of the magnets or magnets 4 can be oriented perfectly parallel with respect to the ship's hull or other fixture to which it will connect, which will provide optimal mooring results.

Finally it is remarked that from FIG. 1 it is clear that the ball and socket joint 7 connects at a central point of the frame 5 so as to arrange that the frame 5 is mirror symmetric left and right of the movable arm construction 3 supporting the frame 5.

As remarked above the mooring device of the invention may be placed ashore to connect to a ship's hull for mooring purposes. According to the invention it is however also possible to provide a ship with one or more mooring devices according to the invention.

The appended claims provide the scope of protection of the instant invention, whereas the foregoing description is intended merely to elucidate any ambiguity that may possibly reside in these claims without the intent to limit the claims to the specific embodiment that has been discussed with reference to the drawing. The scope of protection that merits the invention is therefore solely defined by the appended claims and the construction of these claims should be as broad as is warranted by the invention in view of its contribution to the prior art.

What is claimed is:

1. A mooring device for mooring a ship and comprising a base, a movable arm construction supported by the base, and at least one magnet mounted in a frame, which frame is via a hinge supported by the movable arm construction, wherein the frame comprises a first beam and a second beam that are provided on opposite sides of the hinge, and wherein the first beam supports at least one first leaf spring and a magnet mounted on said at least one first leaf spring, and wherein the second beam supports at least one second leaf spring and a magnet mounted on said at least one second leaf spring.

2. The mooring device according to claim 1, wherein each beam is provided with two leaf springs, each leaf spring supports a magnet, and said two leaf springs are provided on opposite sides of the beam.

3. The mooring device according to claim 1, wherein for each leaf spring the magnet or magnets mounted thereon connect to the leaf spring at a position distant from the beam.

4. The mooring device according to claim 1, wherein each beam is embodied as an H-beam and the leaf spring or leaf springs connect to one leg of the H-beam at a backside of the magnet or magnets so as to arrange that in a rest position a front side of the magnet or magnets can be substantially flush with an opposite leg of the H-beam.

5. The mooring device according to claim 1, wherein the frame is provided with a counterweight or counterweights so as to provide the magnet or magnets mounted to the frame with a preferential orientation in a vertical plane with reference to the hinge.

6. The mooring device according to claim 1, wherein the hinge is embodied as a ball and socket joint.

7. The mooring device according to claim 6, wherein the ball and socket joint connects at a central point of the frame so as to arrange that the frame is mirror symmetric left and right of the movable arm construction supporting the frame.

8. A ship provided with one or more mooring devices according to claim 1.

* * * * *